United States Patent [19]

Williams

[11] 4,279,301

[45] Jul. 21, 1981

[54] METHOD FOR IMPROVING THE EFFECTIVE PERMEABILITY OF FORMATIONS

[75] Inventor: Thomas E. Williams, Ventura, Calif.

[73] Assignee: Texaco Inc., White Plains, N.Y.

[21] Appl. No.: 103,305

[22] Filed: Dec. 13, 1979

[51] Int. Cl.[3] ..... E21B 7/04; E21B 43/24; E21B 43/267; E21B 47/00

[52] U.S. Cl. ..... 166/250; 166/281; 166/303; 166/308; 175/61

[58] Field of Search ..... 166/50, 259, 250, 271, 166/281, 299, 303, 308, 311; 175/61

[56] References Cited

U.S. PATENT DOCUMENTS

| | | | |
|---|---|---|---|
| 2,788,072 | 4/1957 | Goodwin | 166/281 |
| 2,788,956 | 4/1957 | Pevere et al. | 166/259 |
| 3,002,454 | 10/1961 | Chesnut | 166/299 |
| 3,003,557 | 10/1961 | Huitt et al. | 166/271 |
| 3,161,235 | 12/1964 | Carr | 166/281 |
| 3,223,158 | 12/1965 | Baker | 166/259 |
| 3,289,762 | 12/1966 | Schell et al. | 166/308 X |
| 3,587,743 | 6/1971 | Howard | 166/308 X |

*Primary Examiner*—James A. Leppink
*Assistant Examiner*—George A. Suchfield
*Attorney, Agent, or Firm*—Carl G. Ries; Robert A. Kulason; Charles A. Bauer

[57] ABSTRACT

A method to increase the effective permeability of a subterranean hydrocarbon-bearing formation employing a deviated well-drilling scheme and a fracturing technique.

11 Claims, 5 Drawing Figures

— OPEN HOLE WELL BORE AFTER SETTING OF BRIDGE PLUG & CEMENTING TO POINT FOR FIRST DEVIATED WELL BORE

— FIRST DEVIATED OPEN HOLE WELL BORE AFTER FRACTURING, SETTING OF BRIDGE PLUG & CEMENTING TO POINT FOR SECOND DEVIATED WELL BORE

METHOD FOR IMPROVING THE EFFECTIVE PERMEABILITY OF FORMATIONS

FIELD OF THE INVENTION

This invention relates to a method for increasing the productivity or injectivity from hydrocarbon-bearing formations, employing a deviated well-drilling scheme and a fracture technique.

DESCRIPTION OF THE PRIOR ART

Production of hydrocarbons from a hydrocarbon-bearing formation is usually effected by drilling through the hydrocarbon-bearing formation or stratum and opening up the formation around the well bore so as to cause the hydrocarbons therein to flow into the well bore from which they are recovered by conventional methods. The particular method employed to cause the hydrocarbons to be displaced in the formation depends among other things upon the permeability of the hydrocarbon-bearing formation. In formations having a matrix with high permeability of the order of about 100 md. to above 200 md., displacement may be easily obtained with minimum resistance to passage through the matrix. However, many hydrocarbon-bearing formations exist that have low permeability and thus are not amenable to practical commercial production or recovery by conventional methods. These formations may be limestones or tight sand formations in which the permeability may be of the order of 1–2 md.

Various methods have been proposed for increasing the productivity and increasing the drainage area within a desired producing zone or interval. Among these methods for stimulating production, the use of fracturing involving hydraulic fracturing techniques, has generally been employed. Fracturing normally requires the injection into a well bore of a fracturing fluid that may contain a suspended propping agent under sufficient pressure to open a fracture in the exposed formation. Continued pumping of fluid into the well at a high rate extends the fracture and leads to the buildup of a bed of propping agent particles between the fracture walls. These particles prevent complete closure of the fracture as the fluid subsequently leaks off into the adjacent formation and results in permeable channels extending from the well bore into the formation. The fluid conductivities of these channels depend upon the fracture dimensions, the size of the propping agent particles, the particle spacing, and the confining pressures. Equations that can be used to compute the fracture dimensions and fluid conductivities that will be obtained under particular operating conditions have been published in the technical literature and will be familiar to those skilled in the art.

Hydraulic fracturing may be defined as the process in which fluid pressure is applied to the exposed formation rock or matrix until failure or fracturing occurs. After failure of the formation rock, a sustained application of fluid pressure extends the crevice of fracture outward from the point of failure. This fracture creates new and larger flow channels. Generally, once the fracture has been created, selected grades of propping agents are then added to the fracturing fluid in various quantities and deposited in the fractures to support and hold the fracture open. The propping agent is usually placed in the fracture at a pressure equal to or greater than the pressure required to initially fracture the formation. Once the propping agent has been placed and the pressure removed from the formation, the fractures in the formation will tend to close due to overburden pressures in the formation, but are held open by the propping agent. However, aplication has been limited by the inability to extend fracture channels appreciable distances without the necessity of multiple well drilling.

Accordingly, it is the object of the present invention to provide a method for increasing the effective size of the well bore or the drainage area without the necessity of multiple well drilling by providing a relatively high permeability for channels that interconnect in the producing area thereby increasing the drainage area.

SUMMARY OF THE INVENTION

The productivity or injectivity from hydrocarbon-bearing formations is increased, according to the invention, by the use of a deviated well-drilling scheme and a fracturing technique whereby the effective permeability or drainage are around the well bore is increased.

BRIEF DESCRIPTION OF THE FIGURES

FIG. 1 shows the initial open hole well bore after fracturing the productive interval.

FIG. 2 shows the initial open hole well bore after setting of a bridge plug and cementing to the point for first deviated well bore.

FIG. 3 shows the first deviated well bore after fracturing, setting of a bridge plug and cementing to the point for a second deviated well bore.

FIG. 4 shows a second deviated well bore.

FIG. 5 shows the second deviated well bore cased, perforated, fractured and completed as a production well.

DESCRIPTION OF THE PREFERRED EMBODIMENT

Figure 1:
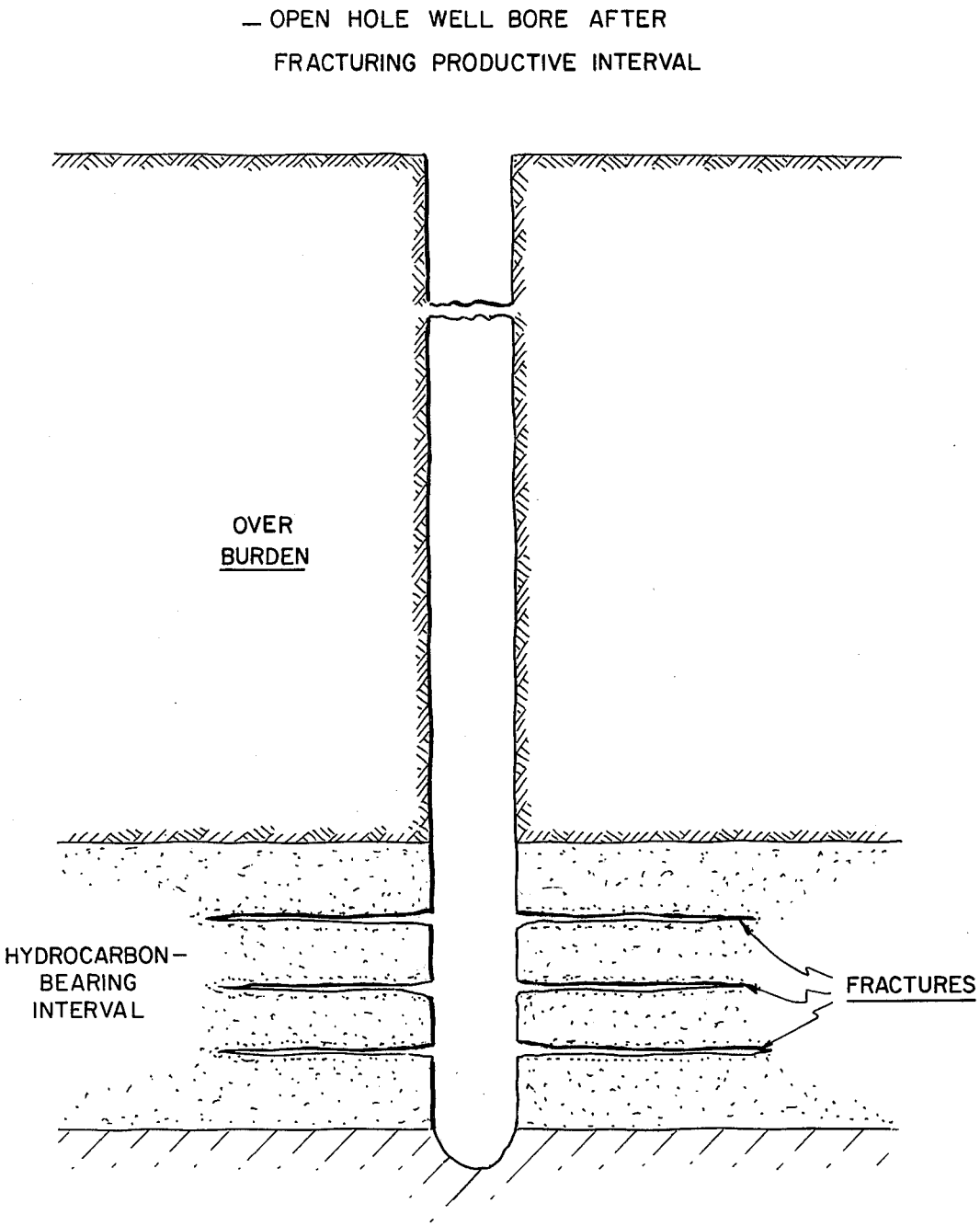
FIGS. 1 through 5 schematically depict the sequence of the operation in carrying out the invention.

In accordance with the present invention a method to improve the productivity or injectivity of a hydrocarbon-bearing formation having at least one productive interval is disclosed comprising first drilling a well bore traversing the productive interval and thereafter fracturing the productive interval adjacent the well bore. After the fracturing has been accomplished and propped, if necessary, the well bore is isolated by setting a bridge plug at the top of the formation and cementing to a desired depth intermediate between the top of the formation and the surface. A second well bore having its upper portion in common with the first well bore but deviated or diverted from the point of the cementing is then drilled. Thereafter, the productive stratum adjacent the deviated or diverted well bore is fractured through the productive interval so as to join with the first fractures and provide communication between the well bores. The second well bore is plugged back by a cementing operation. Additional similarly directionally-drilled holes are then drilled from the common portion of the first well bore and similarly fracturing operations are carried out. By the method of the invention, the final directional well bore is completed by setting casing and perforating it across the desired productive interval so that the well bore becomes a producing well. The method may also be employed wherein the final well bore is completed an an injection well, thereby providing for improved injectivity, as for example, for a steam flood operation. Thus, by the method of the invention, the productivity (or injectivity) of a large area of the formation is effectively increased by a method utilizing a single surface well bore.

In more detail, the practice of the invention involves first drilling a well bore in conventional fashion traversing the hydrocarbon-bearing or productive interval. Thereafter a fracturing fluid is introduced via the drill pipe and is placed in the well bore adjacent with and in contact with the face of the formation to be fractured. Retrievable packers and bridge plugs may be employed to isolate and confine the fracturing fluids to the portion of the productive interval or stratum adjacent the well face desired to be fractured. After the packer is set in the well on the tubing to isolate and confine the selected portion of the formation which is to be fractured, the fracturing operation is carried out utilizing a fracturing fluid such as water or oil, and which may contain a propping agent such as sand, glass beads, or the like. In hydrostatic fracturing, a low-penetrating fluid is pumped into the well. When it reaches the formation which is to be fractured, it tends to stay in the well and build up a high pressure due to its retarded tendency to penetrate the interstices of the formation. Pressure is then applied by the fracture fluid to cause the formation to be fractured and form fissures therein. The pressure required to fracture the formation will depend on the depth and/or the formation being fractured. Suitable fracturing pressures may be in the range of 1,000 to 15,000 psi.

In the situation where the formation thickness is such that more than one fracturing operation is required, or there are multiple hydrocarbon-bearing strata, after the desired fracturing has been accomplished in the selected area, the retrievable packer and bridge plug may be collapsed and relocated across the next selected interval. Thereafter, the fracturing operation is repeated. By continuing this procedure, the desired extent of the productive interval is fractured and propped from the given well bore.

Following the fracture stimulation procedure for the well bore the well bore is cleaned out, since it is desirable to insure that any residue resulting from the stimulation procedure is removed so that the well will flow properly. Cleaning of fracture channels and determination of the effectiveness of the fracture treatment is especially important for the well bores that are to be sealed thereafter and which, therefore, would be inaccessible later. Along with the clean out procedure a production test or testing may also be employed to determine the flow characteristics of the well bore (See FIG. 1).

Figure 2:
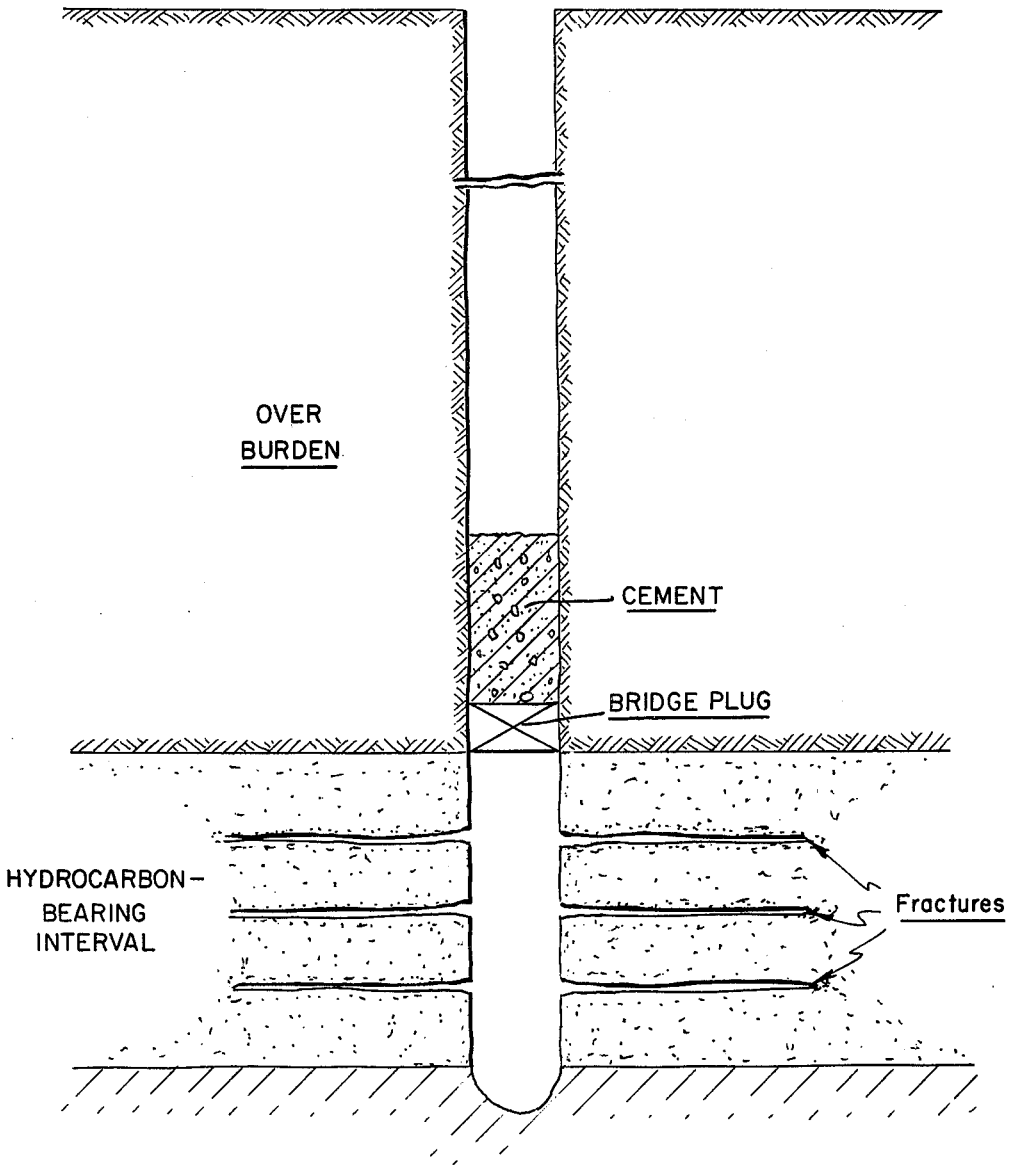

After testing the fracture treatment, an open hole bridge plug, that forms the upper limit of the desired producing interval, is set. The well bore or hole is then cemented above the bridge plug up to a point where the well can be side tracked (See FIG. 2) a second hole directionally is drilled from the point of cementing, and using the same surface well bore. At a level of the well bore, a second well is directionally drilled by the aid of a whipstock or a similar device at an angle from the surface well bore.

In locating and allowing for the directionally drilled second hole, this second well bore should be drilled in a direction and to a depth sufficient so that upon fracturing communication will be achieved between this deviated well bore and the previously drilled and fractured well bore.

Figure 3:
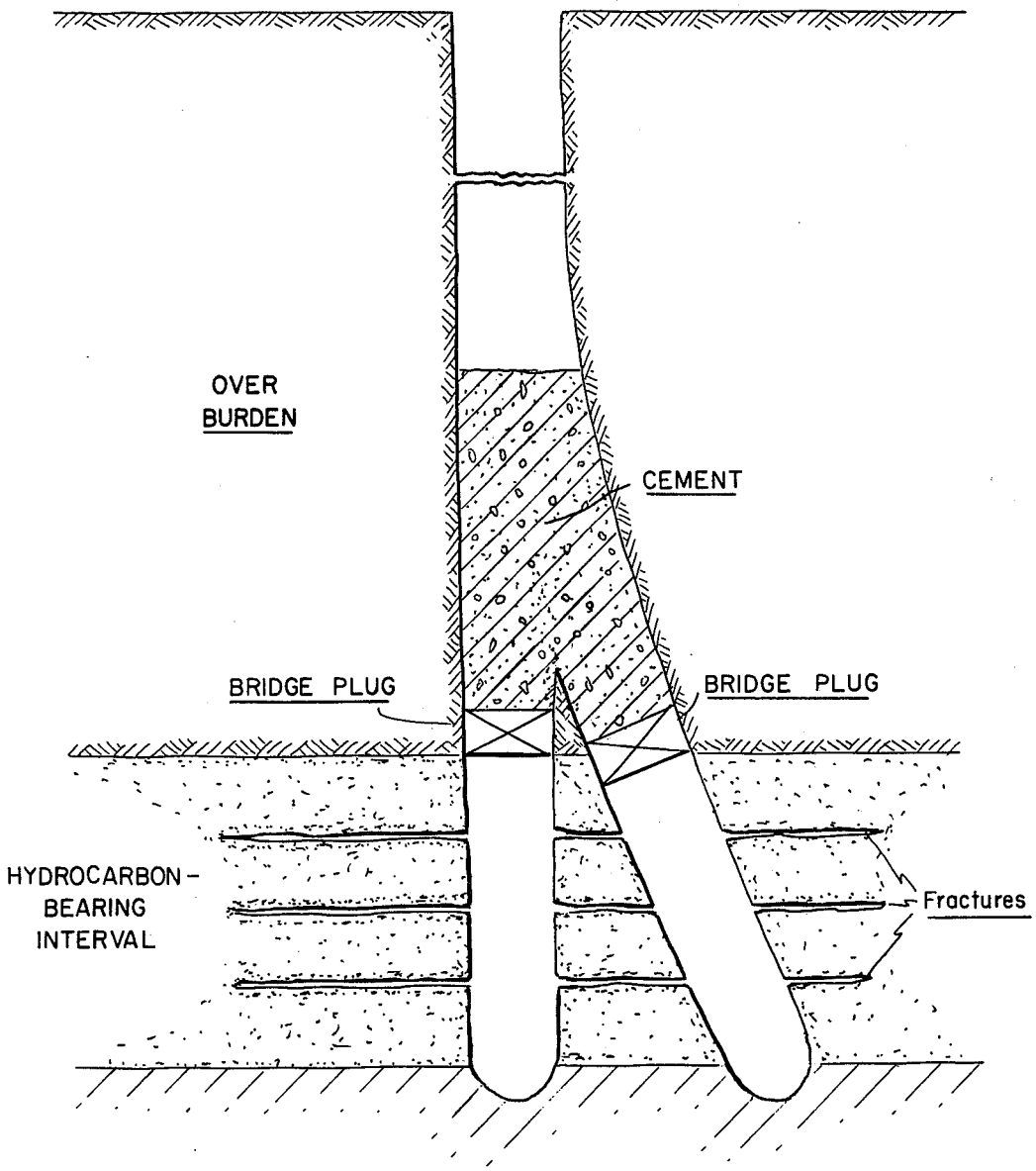

Once the well bore has been directionally drilled at the desired angle and to the desired depth and desired bottom hole location, the well bore is fractured, cleaned out and tested in the manner as described above. Thereafter, the well bore is closed by means of a bridge plug and cemented at this depth (See FIG. 3).

Figure 4:
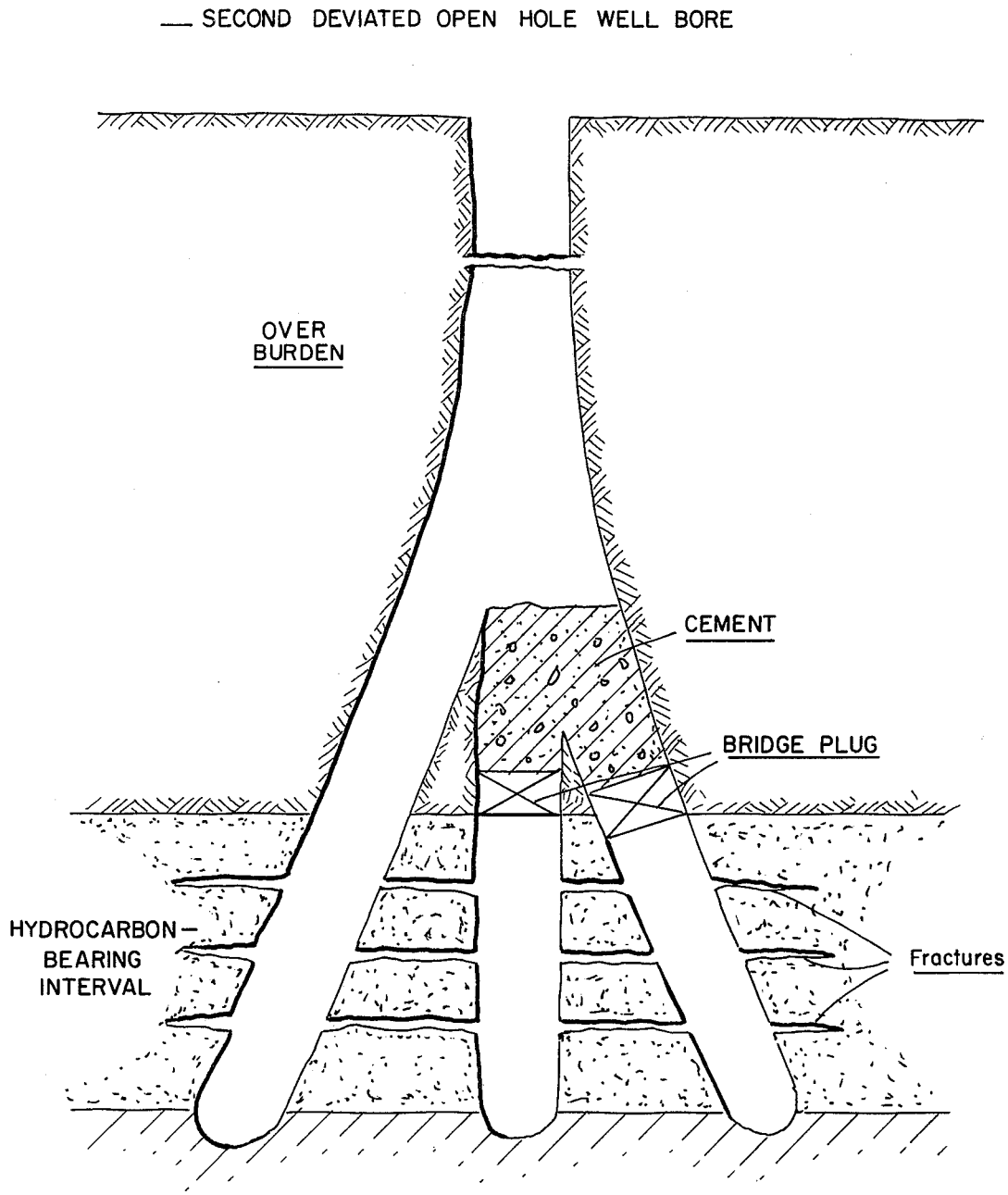
Figure 5:
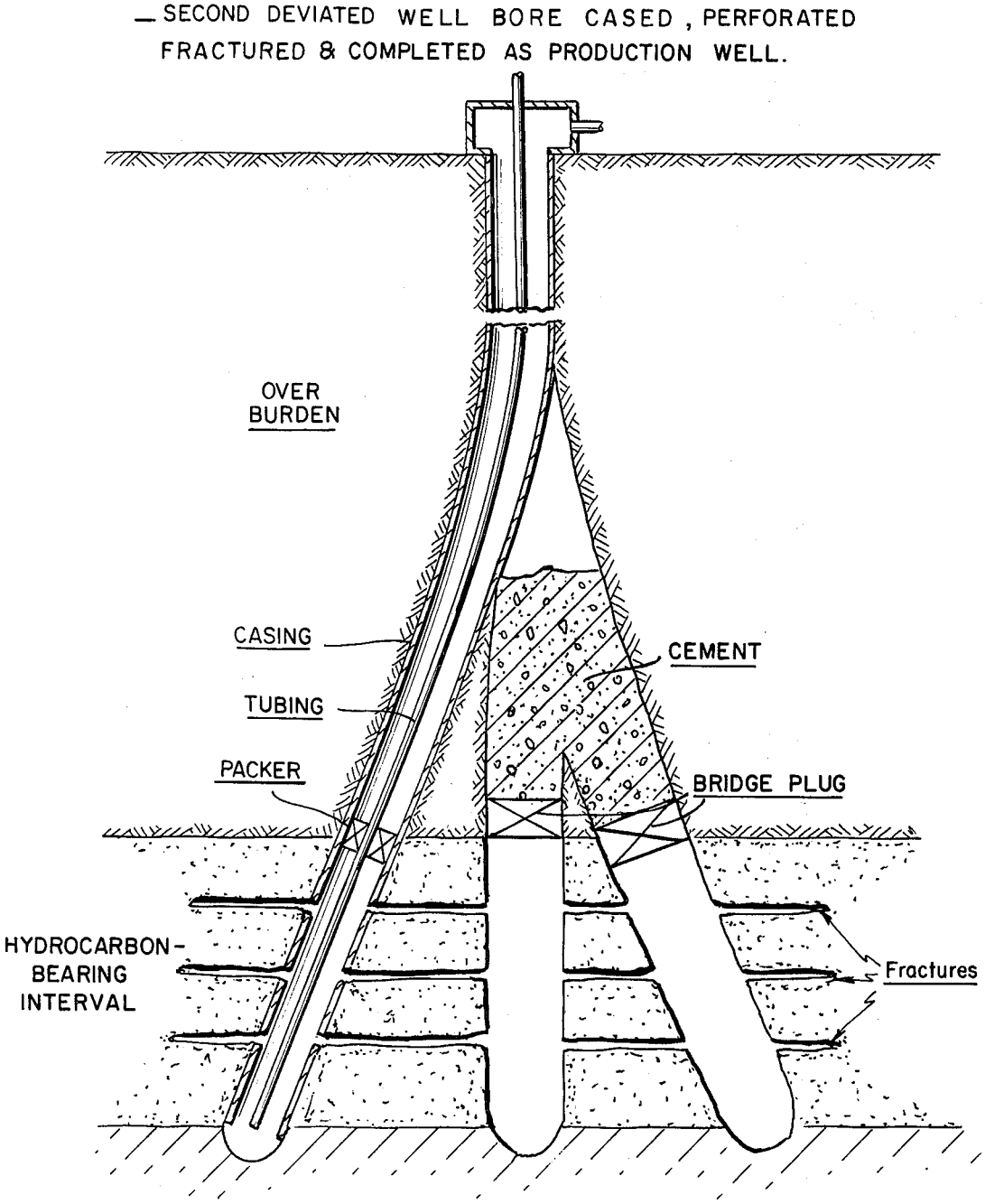

After the completion of the second well bore, a third hole is directionally drilled having the desired angle of deviation, desired depth and desired bottom hole location (See FIG. 4). The third hole is then completed as a producing well and thereafter communication with the other two holes is established by induced fractures. Completion of the third hole follows conventional techniques. The hole may be open hole completed through the production interval or it may be cased, depending upon the type of productive formation. If a cased hole technique is employed, after setting the casing through the producing interval the well is cleaned and tested with the completion fluid and then perforated over the desired producing interval, then fractured employing a procedure similar to those used in the previously drilled deviated holes. The well is then completed as a producing well incorporating the conventional setting of a packer and the necessary tubing means for production (See FIG. 5).

Additional well bores also may be drilled to provide additional directional bore holes in accordance with the procedures for drilling and completing as described above. For purpose of illustration, the method is described in which only three well bores are employed in the producing formation. Nonetheless, the method may be employed for two or more well bores. In addition, although the illustration describes completing the well as a producing well, the well may be completed as an injection well.

Thus by the invention, productivity and recovery of reservoir fluids is enhanced by increasing the effective permeability or drainage area in the formation and increasing flow into all three (or more) well bores and along the lines of the induced fractures, to the completed well bore from which the fluids are produced by conventional means.

Further, it is within the scope of the invention to apply the method for improving the injectivity of injection wells. The method may also be utilized in a steam huff-puff operation whereby the completed well serves not only as a steam injection well, but also as the producing well during the production portion of the operation.

I claim:

1. A method to increase the effective permeability of a subterranean hydrocarbon-bearing formation having at least one productive interval comprising the steps of:

(a) drilling a first well bore traversing said productive interval of said hydrocarbon-bearing formation, (b) fracturing said first well bore adjacent said productive interval, (c) setting a bridge plug above said productive interval in said first well bore and thereafter undertaking a cementing operation in said first well bore to a desired depth, (d) drilling a second well bore having the upper portion thereof in common with said first well bore and deviated from said first well bore from the top of said cementing operation and thereafter fracturing said productive interval adjacent said deviated second well bore, (e) setting a bridge plug above the productive interval in said second well bore and thereafter undertaking a cementing operation in said second well bore to a desired depth, (f) repeating steps (d) and (e) to provide additional similarly deviated well bores, (g) drilling a final similarly deviated well bore and completing said final well bore by setting tubing and packer.

2. The method of claim 1 wherein said fracturing is accomplished by sequentially fracturing segments of said productive interval.

3. The method of claim 2 wherein said fracturing of said segments employs the steps of:

(a) setting a retrievable packer and a retrievable bridge plug to isolate one of said segments, (b) fracturing said one segment, (c) relocating said packer and said bridge plug to isolate a second segment of said interval, (d) fracturing said second segment of said interval, (e) repeating steps (a) and (b) to accomplish the fracturing of said productive interval.

4. The method of claim 1 wherein said subterranean hydrocarbon-bearing formation comprises more than one productive interval.

5. The method of claim 1 wherein said well bore is cleaned out and a production test is performed prior to the cementing operation.

6. The method of claim 1 wherein a plurality of similarly deviated well bores are drilled through said productive interval.

7. The method of claim 1 wherein said deviated well bores are spaced apart and whereby communication below said bridge plugs is established among said deviated well bores upon said fracturing.

8. The method of claim 1 wherein said deviated well bores are drilled to substantially the same productive depth.

9. The method of claim 1 wherein said final deviated well bore is completed as a production well means.

10. The method of claim 1 wherein said final deviated well bore is completed as an injection well means.

11. The method of claim 1 wherein said final deviated well bore is completed to serve as both an injection well means and as a production well means.

* * * * *